US008020909B1

(12) United States Patent
LaVaque

(10) Patent No.: US 8,020,909 B1
(45) Date of Patent: Sep. 20, 2011

(54) PINCERS ILLUMINATING ITEMS GRASPED THEREIN

(76) Inventor: Barry J. LaVaque, Mosinee, WI (US)

( * ) Notice: Subject to any disclaimer, the term of this patent is extended or adjusted under 35 U.S.C. 154(b) by 317 days.

(21) Appl. No.: 12/394,794

(22) Filed: Feb. 27, 2009

Related U.S. Application Data

(60) Provisional application No. 61/034,665, filed on Mar. 7, 2008.

(51) Int. Cl.
*B25B 7/00* (2006.01)

(52) U.S. Cl. ..... 294/99.2; 606/210

(58) Field of Classification Search ..... 294/16, 294/99.2; 606/210, 211
See application file for complete search history.

(56) References Cited

U.S. PATENT DOCUMENTS

| | | | | |
|---|---|---|---|---|
| 4,852,929 | A * | 8/1989 | Shafir | 294/99.2 |
| 5,002,561 | A * | 3/1991 | Fisher | 606/210 |
| 5,242,203 | A | 9/1993 | Agnew et al. | |
| 6,179,847 | B1 * | 1/2001 | Possum | 606/131 |
| 6,280,449 | B1 * | 8/2001 | Blake | 606/107 |
| 7,073,832 | B1 | 7/2006 | Lavaque et al. | |
| 2004/0006357 | A1 * | 1/2004 | Baldesberger | 606/167 |
| 2008/0243181 | A1 * | 10/2008 | Schneider et al. | 606/211 |
| 2009/0021033 | A1 * | 1/2009 | Khubani | 294/99.2 |

* cited by examiner

*Primary Examiner* — Saul Rodriguez
*Assistant Examiner* — Stephen Vu
(74) *Attorney, Agent, or Firm* — Craig A. Fieschko, Esq.; DeWitt Ross & Stevens S.C.

(57) ABSTRACT

A pincer (e.g., a tweezer) has tips which are at least substantially transparent, such that a user can at least partially view an object being grasped through the tips, and/or such that the tips collect and channel incident light onto the grasped item. The tips preferably have an exterior which is convex in one or more dimensions, and are configured and/or coated such that light falling on the tip exteriors is focused onto a spot or band on the item. Since the tips can enhance illumination of an item being grasped, they can particularly enhance the viewing of translucent materials such as gemstones or selected biological materials.

20 Claims, 2 Drawing Sheets

PINCERS ILLUMINATING ITEMS GRASPED THEREIN

CROSS-REFERENCE TO RELATED APPLICATIONS

This application claims priority under 35 USC §119(e) to U.S. Provisional Patent Application 61/034,665 filed 7 Mar. 2008, the entirety of which is incorporated by reference herein.

FIELD OF THE INVENTION

This document concerns an invention relating generally to pincers (i.e., tweezers, tongs, pliers, and the like) for grasping items (particularly small items), and more specifically to pincers which enhance the visibility of the item being grasped, as by transmitting light through the grasping faces of the pincers to illuminate the item being grasped.

BACKGROUND OF THE INVENTION

In some fields it is often necessary to grasp and carefully inspect small objects. As examples, in the jewelry/geomology field, jewelers or customers may need to pick up and examine a gemstone; in the medical/bioscience fields, a technician may need to pick up and examine a piece of biological matter; and in the electronics field, a technician may need to pick up and examine a small electronic component. Tweezers or other fine pincers are often used for this purpose. However, a common problem is that the pincers often obstruct the item being viewed, blocking an observer's view of at least the regions of the item being grasped. The pincers also tend to shadow the item and make it darker, at least at the regions of the item being grasped. This is particularly problematic where the item being grasped relies on illumination from multiple angles for proper viewing, e.g., in the case of gemstones: it is common for a diamond to appear brilliant when placed on a flat surface and illuminated, but when picked up by jeweler's tweezers, the tweezers prevent light input at the grasped regions and darken the diamond. (Diamonds are generally cut so that as much light as possible that falls on the diamond is transmitted to the diamond's main face via internal reflection, effectively making the main face emit more light than it receives, and thus blocking light input can make the diamond appear darker.) The darkening of the stone can then be compounded by the stone's transmission of images of the grasping faces of the tweezer to the diamond's main face, giving the stone a greyish cast.

SUMMARY OF THE INVENTION

The invention involves pincers (i.e., tweezers, tongs, pliers, and the like) which are intended to at least partially solve the aforementioned problems. To give the reader a basic understanding of some of the advantageous features of the invention, following is a brief summary of a preferred version of the pincers, with reference being made to the accompanying drawings (which are briefly reviewed in the following "Brief Description of the Drawings" section of this document) to assist the reader's understanding. Since the following discussion is merely a summary, it should be understood that more details regarding the preferred versions may be found in the Detailed Description set forth elsewhere in this document. The claims set forth at the end of this document then define the various versions of the invention in which exclusive rights are secured.

A perspective view of a pincer 100 which exemplifies concepts of the invention is provided in FIG. 1A, with the tips of the pincer 100 being schematically illustrated from the side in FIG. 1B and from the top in FIG. 1C, and with a front view (i.e., with the pincer 100 being seen from the tips rearwardly) in FIG. 1D. The pincer 100 includes a pair of legs 102 extending from a pivot 104, with each leg 102 having an outer leg side 106 and an inner leg side 108, wherein the outer leg sides 106 face outwardly from the pincer 100 and the inner leg sides 108 face each other. Opposing transverse leg sides 110 are situated between the outer and inner leg sides 106 and 108. Each leg 102 also has a grasping face 112 on its inner leg side 108, with the legs 102 being pivotable about the pivot 104 to have the grasping faces 112 approach each other, thereby allowing an item to be grasped between the grasping faces 112. At least one of the legs 102—and preferably both of the legs 102—is at least partially translucent between its grasping face 112 and a portion of the outer leg side 106 opposite the grasping face 112, whereby light incident on this portion is transmitted through the leg 102 toward the grasping face 112. As a result, when an item—e.g., a gemstone such as a diamond—is grasped between the grasping faces 112, the item is not eclipsed by the grasping faces 112, and instead light from the exterior of the pincer 100 (i.e., light incident on the outer leg side 106) is at least partially passed to the item. In the case where the item is a diamond or other gemstone, this can enhance the brilliance of the gemstone (as simulated in FIG. 2, which compares the possible appearance of a diamond 10 grasped by conventional jewelers' tweezers 50 with the possible appearance of the same diamond 10 grasped by the pincer 100). Most preferably, the portion of the outer leg side 106 opposite the leg's grasping face 112 defines an at least partially convex outer surface 114, whereby light incident on this convex outer surface 114 is transmitted through the leg 102 and is at least partially focused toward the grasping face 112. In this case, the leg's grasping face 112 is preferably at least substantially planar, with the grasping face 112 and convex outer surface 114 of the leg 102 effectively defining a planoconvex lens to better focus light towards a grasped item.

In the pincer 100, the legs 102 are formed with leg bodies 116 having rearward ends 118 at or near the pivot 104, and which extend from the pivot 104 to forward terminal ends 120. These leg bodies 116 are preferably formed of an opaque, durable, and resiliently flexible material, such as thin sections of stainless steel. The legs 102 then join to grasping sections 122 at their forward terminal ends 120, with these grasping sections 122 preferably defining the tips of the pincer 100 and being formed of translucent material such as glass, optical plastics (e.g., polymethylmethacrylate, cellulose acetate butyrate, polycarbonate, glycol-modified polyethylene terephthalate, etc.), or similar materials. Each grasping section 122 has a rearward portion 124 affixed to a forward terminal end 120 of one of the leg bodies 116 via adhesive, fasteners, or other means of attachment. A forward portion 126 extends forwardly of the rearward portion 124, and includes at least a part of the grasping face 112 and the convex outer surface 114. Most preferably, each grasping section 122 is at least substantially translucent between its rearward portion 124 and its grasping face 112 so that light incident on the rearward portion 124 is captured and at least partially channeled to the grasping face 112 via internal reflection. This can enhance light emission at the grasping faces 112, and thereby increase the illumination of an item being grasped. It is also notable that the grasping sections 122, being at least partially translucent, also allow at least partial visibility of any grasped item through the grasping sections 122 themselves, thereby better increasing a user's visibility of the grasped item. Additionally, the convex outer surface 114 of each grasping section 122 preferably extends outwardly from the outer leg side 106 of its adjacent leg body 116 so that the convex outer leg 102 surface is less obscured by the leg body 116, and is able to collect more light to be channeled to the grasping face 112.

As seen best in FIG. 1C, each leg 102 preferably smoothly and continuously tapers in width as it extends toward the forward terminus 128 of its grasping section 122 such that the leg 102 sections present a broader and more comfortable region for gripping/squeezing, while the grasping section 122 exposes more of the item being grasped for less obstructed viewing. In particular, it is preferred that the grasping section 122 has a width, as measured transversely from an axis extending along the length of the leg 102, which increases or is constant across the grasping face 112 in a direction extending toward the pivot 104 (i.e., the grasping face 112 preferably does not broaden as it extends toward the forward terminus 128 of its grasping section 122).

Further advantages, features, and objects of the invention will be apparent from the remainder of this document in conjunction with the associated drawings.

DETAILED DESCRIPTION OF PREFERRED VERSIONS OF THE INVENTION

Figure 3:
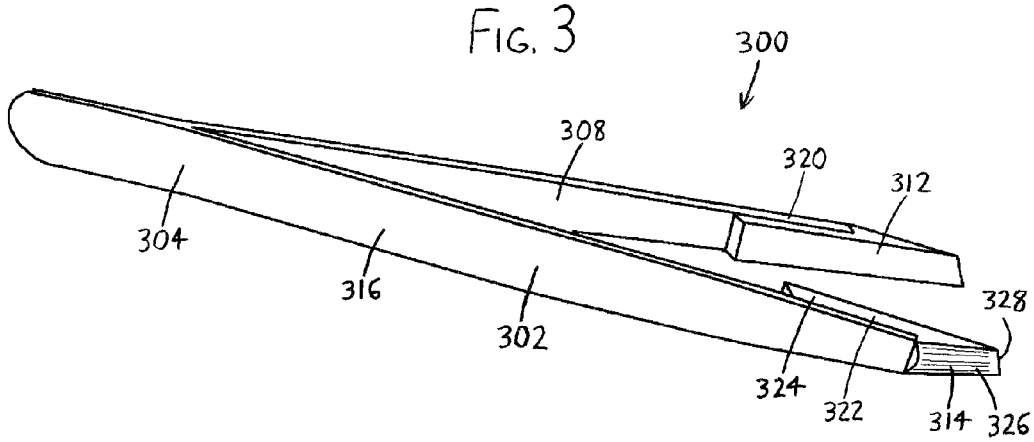
FIG. 3 is a simplified perspective view of another exemplary pincer 300 which has grasping sections 322 with rearward portions 324 affixed to the inner sides 308 of the bodies 316 of the legs 302, with the grasping sections 322 having convex outer surfaces 314 which are inclined to define a chisel/wedge tip.

Expanding on the discussion above, FIG. 3 illustrates another exemplary pincer 300 which illustrates concepts of the invention. As with the pincer 100, the pincer 300 includes leg bodies 316 extending forwardly from a pivot 304 to terminal ends 320, with at least partially translucent grasping sections 322 being situated thereon and bearing grasping faces 312 for grasping items when brought together. The pincer 300 operates in substantially the same manner as the pincer 100 of FIGS. 1A-1D, with light incident on the convex outer surfaces 314 of the grasping sections 322 focusing light onto an item grasped between the grasping faces 312. However, the grasping sections 322 differ from the grasping sections 122 of FIGS. 1A-1D in that they include rearward portions 324 situated on the inner leg sides 308 of the leg bodies 316, thereby effectively enlarging the grasping faces 312, which here extend across both the forward portion 326 and the rearward portion 324 of the grasping sections 322. Light collected at the convex outer surface 314 can be transmitted to both of these portions 324 and 326 to illuminate items held between the grasping faces 312. Additionally, the convex outer surfaces 314 of the grasping sections 322 decrease in thickness as they extend forwardly to their forward terminal ends 328, thereby defining a chisel/wedge-type tip.

Figure 4:
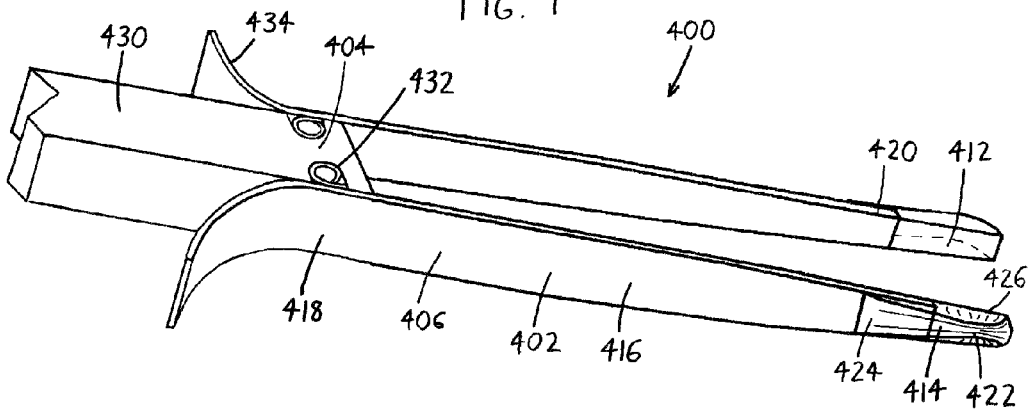
FIG. 4 is a simplified perspective view of another exemplary pincer 400 having legs 402 mounted on springs 432 at a pivot 404, with the legs 402 terminating in grasping sections 422 which are convex in both an axial direction (i.e., along the lengths of the legs 402) and a transverse direction (i.e., across the widths of the grasping sections 422) to at least partially focus light incident on their outer surfaces 414 onto a spot on a grasped item.

FIG. 4 then depicts another exemplary pincer 400 illustrating concepts of the invention. In this case, the pincer 400 has leg bodies 416 extending from, and pivotally mounted to, a handle member 430. A forward portion of the handle member 430 thereby effectively defines the pivot 404, and it bears springs 432 which urge the leg bodies 416—and their forward terminal ends 420 and the grasping sections 422—together, such that the grasping faces 412 on the grasping sections 422 may grasp an item therebetween. Grips 434 on the rearward ends 418 of the leg bodies 416 can be manipulated by a user to defeat the springs 432 and open the legs 402 to accept an item to be grasped; otherwise, the legs 402 are biased closed. The grasping sections 422 are fit to the outer leg sides 406, as with the pincer 100 of FIGS. 1A-1D, but the outer surfaces 414 of the grasping sections 422 are convex in two dimensions, both axially (along the length of the legs 402/grasping sections 422) and transversely (along the widths of the legs 402/grasping sections 422). In contrast, in the pincer 100 of FIGS. 1A-1D, the outer leg surface 114 opposite the grasping face 112 of each grasping section 122 is convex in only one dimension (transversely), with the thickness of the leg 102 increasing as the leg 102 extends inwardly towards its midsection from its transverse leg sides 110 (see particularly FIGS. 1A and 1D). The grasping sections 422 of the pincer 400 have this characteristic as well, but the thickness of the grasping sections 422 also increase as than the grasping sections 422 extend inwardly from the opposing ends of their rearward portions 424 and forward portions 426, such that convexity is also provided in the axial direction (i.e., along the length of the legs 402). Convexity in multiple dimensions can help focus collected light onto a spot on the item being grasped, whereas convexity along only one dimension might focus light onto a band or line on the item being grasped. With appropriate configuration of the grasping section outer surfaces 114/314/414 of the pincers 100/300/400 of FIGS. 1A-1D and FIGS. 3-4, light falling on these outer surfaces can be focused into spots, bands, or other shapes of desired size.

Various preferred versions of the invention have been discussed to illustrate possible forms that the invention may take, but it should be understood that the invention can also assume forms which vary widely from those discussed above in appearance, features, and functions. Following is an exemplary list of other features and functions that might be incorporated instead of (or in addition to) those noted above, with reference being made to the pincer 100 of FIGS. 1A-1D for sake of example.

Using the pincer 100 as an example, the grasping sections 122 and their grasping faces 112 need not be provided at the terminal ends of the legs 102 of the pincer 100. For example, a wholly or partially transparent grasping section 122 might be situated partway along the length of a leg body 116, with its grasping face 112 facing the opposing leg 102 and with its outer leg surface 114 being exposed to the outside of the pincer 100 (as by extending through an aperture in the leg body 116), and with the leg body 116 extending forwardly of the grasping section 122 (e.g., perhaps defining a sharp probe/pick or other tool structure). Simply stated, the portion of a pincer 100 used to grasp an item need not be at the very tip of the pincer 100.

The leg bodies 116 and grasping sections 122 need not be formed of different materials, nor need they be separately formed. Such an arrangement is preferred because it concentrates attention on the item being grasped, rather than on the legs 102 of the pincer 100 (which can be useful for a jeweler or gemologist who seeks to sell the item being grasped). However, it could be possible to (for example) form the entire pincer 100, both the leg bodies 116 and grasping sections 122, from molded translucent plastic having sufficient flexibility that the legs 102 can bend about the pivot 104 to grasp an item.

The grasping sections 122 allow at least some of the light collected at the rearward portions 124 of the grasping sections 122 to be transmitted forwardly for emission at the grasping faces 112. This transmission of light to the grasping sections 122 can be enhanced with careful choice of the material used to form the grasping sections 122, and with careful configuration of the grasping sections 122, such that internal reflection is enhanced (e.g., such that light collected at the rearward portions 124 of the grasping sections 122 has difficulty escaping from the surfaces of the grasping sections 122, in a manner similar to that of a fiberoptic cable, unless/until the light encounters the grasping faces 112). For example, a grasping section 122 could be designed to take in light over its length, reflect it internally (owing to the angling/configuration of its surfaces, and/or owing to surface treatments/coatings on all or selected ones of its surfaces), and transmit the collected light out of its grasping face 112 (and thus into/onto the item being grasped). Suitable coatings, for example coatings similar to those used for mirrored sunglasses, can also be used at the grasping faces 112 to deter light reflection/emission from a grasped object back into the grasping faces 112, and then from the outer surfaces of the grasping sections 122 (which can be distracting).

Unless the pincer 100 is intended to enhance the coloration of an item being grasped (e.g., a gemstone), the translucent portions of its grasping sections 122 are preferably not colored (i.e., they preferably do not attenuate or shift the wavelengths of any transmitted light). If the pincer 100 is intended to modify an item's coloration, the grasping sections 122 might be coated to filter out colors other than those that are desired to be imparted to the grasped item. In similar respects, coatings which reject certain selected wavelengths may be desirable on the grasping sections 122 to avoid transmission of these wavelengths into an item being grasped. As an example, ultraviolet is known to cause fluorescence of imperfections in some gemstones, which can then give the stones some degree of visible coloration (e.g., a yellowish hue, which can decrease the attractiveness of the stone). Thus, by coating the grasping sections 122 to maximize visible light transmission into the gem being grasped, and decreasing or eliminating UV transmission, the attractiveness of the grasped gem might be enhanced.

It is also possible that a pincer 100 could be constructed with a built-in light source, such as an LED (light-emitting diode) or other illumination source. For example, an LED or other light source could supply light into the end of the rearward portion 124 of the grasping section 122 to transmit light forwardly towards the grasping face 112. In this case, it may be desirable to coat or angle the forward end of the forward portion 126 of the grasping section 122, else much of the light incident on the rearward portion 124 will be emitted from the forward portion 126. As another example, the legs 102 (i.e., the leg bodies 116 and grasping section 122) could be integrally molded of translucent plastic, and an LED chip (i.e., a light-emitting semiconductor such as those embedded in the lens/capsule of conventional LEDs) can be molded within each leg 102, effectively turning each leg into an LED with the lens/capsule being defined by the legs 102. Light emitted by each LED can then be transmitted down the length of a leg 102 via internal reflection to be emitted at the grasping face 112.

Grasping sections 122 need not have convex outer surfaces 114, and grasping sections 122 could simply be formed as (for example) flat paddle-like members which allow easy viewing of the item being grasped through the grasping sections 122, with little or no optical distortion. In some cases, the ability to view an item through the grasping sections 122 can be valuable regardless of any light concentration that the grasping sections 122 may provide onto the grasped item. This can be particularly useful in the gemology and medical/bioscience fields, where users often wish to examine grasped items from all sides (and where this can only be done with conventional pincers by putting down an item and re-grasping it at different locations so that the areas to be seen are not obstructed). Regarding particularly the medical/bioscience field (where the pincer 100 might be configured as a hemostat or the like), it is notable that it may be possible to direct a laser through the grasping sections 122, if properly configured, to cauterize, photostimulate, or otherwise affect a grasped area of an item.

The entirety of a grasping section 122 at the end of a leg 102 need not be translucent, and the translucent portion of the grasping section 122 might simply be provided as a window or the like surrounded within the remainder of the (opaque) grasping section 122. However, since most translucent materials are nonmetallic and non-magnetic, it is preferred that the grasping sections 122 be formed of translucent materials in their entireties. This avoids accidental magnetization of the grasping sections 122, which can be problematic when the pincer 100 is used to handle semiconductor devices or other microelectronics.

The grasping sections 122 are preferably joined to the forward terminal ends 120 of the leg bodies 116 via fasteners (as by extending a fastener through the rearward portion 124 of the grasping section 122 into the forward terminal end 120 of the leg body 116), adhesives, and/or by a complementary interfit (e.g., by having the protruding forward terminal end 120 of a leg body 116 extend into a socket defined in the rearward portion 124 of a grasping section 122). Other means of attachment are also possible. Grasping sections 122 can be removable and replaceable, allowing different combinations of similar or dissimilar grasping sections 122 to be used on a pincer 100, and allowing replacement in the case of wear.

Figure 1A:
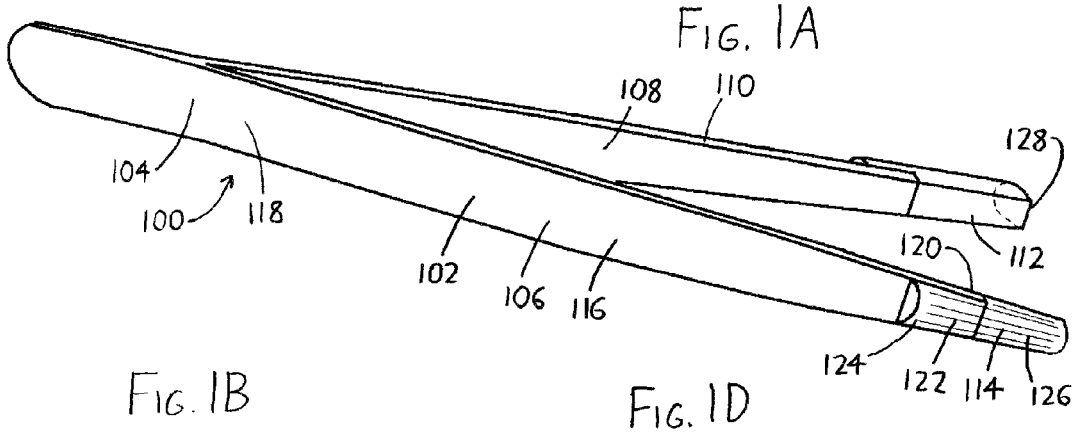
FIG. 1A is a simplified perspective view of an exemplary pincer 100 having leg bodies 116 extending forwardly from a pivot 104 to terminate in translucent grasping sections 122 having convex outer surfaces 114 and opposing grasping faces 112 which are at least substantially planar, whereby light incident on the outer surfaces 114 is at least partially focused on the grasping faces 112 (and thus on any items being grasped).
Figure 1B:
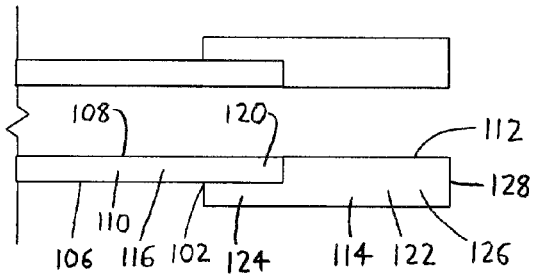
FIG. 1B is a simplified side elevational view of the grasping sections 122 (and portions of the leg bodies 116) of the pincer 100 of FIG. 1A.
Figure 1D:
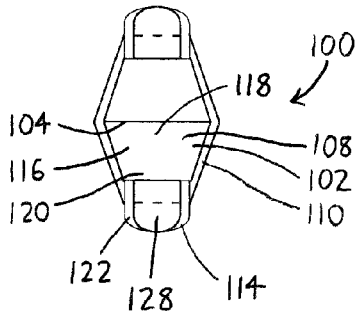
FIG. 1D is a front view of the pincer 100 of FIG. 1A, as viewed a location in front of the forward terminus 128 of the grasping section 122 and looking rearwardly toward the pivot 104.
Figure 1C:
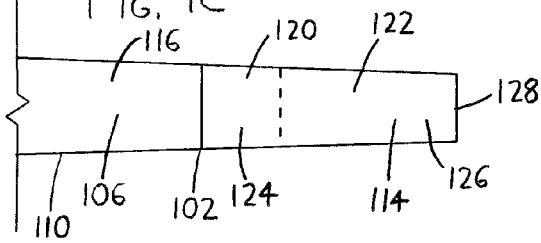
FIG. 1C is a top plan view of the grasping sections 122 (and portions of the leg bodies 116) of FIGS. 1A-1B.
Figure 2:
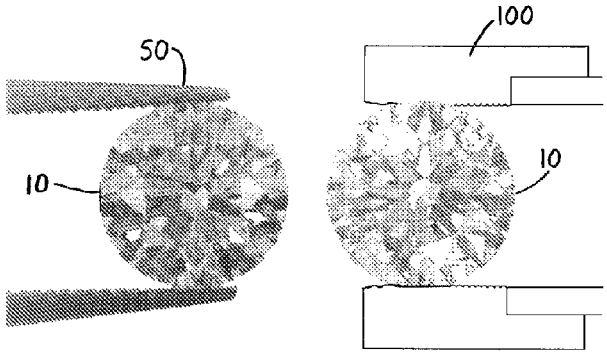
FIG. 2 depicts, in a simplified manner, a simulation of the different appearance of a diamond (or other gemstone) 10 grasped by an ordinary jeweler's tweezers 50, and one grasped with the tweezers/pincer 100 of FIG. 1A (with the grasping faces 112 of the pincer 100 here being shown with ridges/indentations which enhance the grip on the gemstone).

The pincer 100 may be adapted to incorporate features conventional to prior art pincers having different configurations than those discussed above. As examples, features such as those shown and/or discussed in U.S. Pat. No. 5,242,202 to Agnew and/or U.S. Pat. No. 7,073,832 to LaVague et al. could be incorporated, e.g., a handle similar to that shown in FIG. 4; an optical loupe/microscope situated adjacent the region between the grasping faces 112; etc. Slides, catches, springs, or other structures for locking the legs 102 in a closed state (or in an open state) could also or alternatively be provided. The grasping faces 112 may include a series of ridges (as illustrated in FIG. 2), or may contain indentations which are specially shaped and sized to receive particular items, so that a better grip on grasped items is provided. Pivots 104 could take the form of hinged arrangements such as pins about which the legs 102 rotate, or could take any other form allowing the legs 102 to interact to grasp items. The legs 102 may pivot with respect to each other from the ends of their lengths (as in the depicted pincer 100 of FIG. 1A), or the pivot 104 may be located along the lengths of the legs 102 (as in pliers or similar instruments), or the pivot 104 may even be located off of the lengths of the legs, so long as the legs 102 can interact to grasp items.

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. A pincer including a pair of legs extending from a pivot, each of the legs having a grasping face thereon, wherein:

a. the legs are pivotable about the pivot to have the grasping faces approach and withdraw from each other, whereby an item may be grasped between the grasping faces; and b. each of the legs has an outer leg side and an opposing inner leg side, with:

(1) the outer leg sides facing outwardly from the pincer, and (2) the inner leg sides facing each other, with the grasping faces being situated thereon;

c. one of the legs is at least partially translucent between the outer leg side and the grasping face, whereby an ambient light incident on the outer leg side is transmitted through the leg and is at least partially focused toward the grasping face, and wherein the pincer lacks any illumination source affixed thereon or therein.

2. The pincer of claim 1 wherein the at least partially translucent leg has an at least partially convex outer leg side.

3. The pincer of claim 2 wherein one of the legs having an at least partially convex outer leg side is convex in a direction extending transversely with respect to an axis extending along the length of the leg, whereby the leg has opposing transverse leg sides with a leg transverse midsection therebetween, with the leg transverse midsection having greater thickness than the transverse leg sides.

4. The pincer of claim 2 wherein one of the legs having an at least partially convex outer leg side is convex in a direction extending axially along the length of the leg, whereby the leg has opposing front and rear leg sides with a leg axial midsection therebetween, with the leg axial midsection having greater thickness than the front and rear leg sides.

5. The pincer of claim 2 wherein one of the legs having an at least partially convex outer leg side is convex in both:

a. a direction extending axially along the length of the leg, and b. a direction extending transversely with respect to an axis extending along the length of the leg.

6. The pincer of claim 2 wherein both of the legs:

a. have an at least partially convex outer leg side opposite the grasping face, and b. are at least partially translucent between the partially convex outer leg side and the opposing grasping face.

7. The pincer of claim 1 wherein the legs have widths, as measured transversely with respect to axes extending along the lengths of the legs, which do not decrease across the grasping faces in a direction extending toward the pivot.

8. The pincer of claim 1 wherein the legs include:

a. grasping sections thereon, each of the grasping sections being formed of at least substantially translucent material and having one of the grasping faces thereon, and b. leg bodies thereon, each of the leg bodies:

(1) extending from a rearward end at or near the pivot to a forward terminal end, and (2) being formed of opaque material, wherein the grasping sections are:

i. situated on the forward terminal ends of the leg bodies, and ii. spaced from the pivot by the leg bodies.

9. The pincer of claim 8 wherein:

a. one of the grasping sections includes an at least partially convex outer surface opposite the grasping face, and b. the at least partially convex outer surface protrudes both forwardly from and outwardly with respect to the adjacent leg body.

10. The pincer of claim 8 wherein each of the grasping sections includes:

a. a rearward portion affixed to the forward terminal end of one of the leg bodies, and b. a forward portion extending forwardly of the rearward portion, with the forward portion including at least a part of the grasping face, wherein each of the grasping sections is at least substantially translucent between the rearward portion and the grasping face.

11. A pincer including a pair of legs extending from a pivot, each of the legs having an outer leg side and an inner leg side, wherein:

a. the outer leg sides face outwardly from the pincer and the inner leg sides face each other, b. each of the inner leg sides includes a grasping face thereon, with the legs being pivotable about the pivot to have the grasping faces approach and withdraw from each other, whereby an item may be grasped between the grasping faces, c. one of the is at least partially translucent between the leg's grasping face and a portion of the outer leg side opposite the grasping face, with the portion of the outer leg side opposite the grasping face defining an at least partially convex surface, whereby a light incident on this portion is transmitted through the leg and is at least partially focused toward the grasping face.

12. The pincer of claim 11 wherein both of the legs are at least partially translucent between the grasping face and a portion of the outer leg side opposite the grasping face.

13. The pincer of claim 11 wherein the at least partially translucent leg has a width, as measured transversely with respect to an axis extending along the length of the leg, which does not decrease across the grasping face in a direction extending toward the pivot.

14. The pincer of claim 13 wherein the pincer lacks any illumination source affixed thereon or therein.

15. The pincer of claim 14 wherein the at least partially translucent leg includes:

a. a grasping section thereon, the grasping section:

(1) being formed of at least substantially translucent material, (2) having one of the grasping faces thereon, and (3) being spaced from the pivot;

b. a leg body thereon, the leg body:

(1) extending from the pivot to join to the grasping section, and (2) being formed of opaque material.

16. A pincer including:

i. a pivot with a pair of legs extending therefrom, and ii. opposing grasping faces on the legs, whereby the legs can be pivoted about the pivot so that the grasping faces approach and withdraw from each other, wherein one of the legs:

a. is at least partially translucent between the grasping face and a portion of the outer leg side opposite the grasping face, whereby a light incident on this portion is transmitted through the leg toward the grasping face, and b. has a width, as measured transversely from an axis extending along the length of the leg, which does not decrease across the grasping face in a direction extending toward the pivot.

17. The pincer of claim 16 wherein the at least partially translucent leg has an at least substantially plano-convex cross section with:

a. the grasping face of the leg being at least substantially planar, and b. an at least partially convex outer leg side opposite the grasping face.

18. The pincer of claim 16 wherein both of the legs are at least partially translucent between each of the grasping faces and a portion of the outer leg side opposite the grasping face.

19. The pincer of claim 16 wherein the pincer lacks any illumination source affixed thereon or therein.

20. The pincer of claim 16 wherein the at least partially translucent leg includes:

a. a grasping section thereon, the grasping section:

(1) being formed of at least substantially translucent material, (2) having one of the grasping faces thereon, and (3) being spaced from the pivot;

b. a leg body thereon, the leg body:

(1) extending from the pivot to join to the grasping section, and (2) being formed of opaque material.

* * * * *